US012789314B2

(12) United States Patent
Zuniga et al.

(10) Patent No.: US 12,789,314 B2
(45) Date of Patent: Nov. 10, 2026

(54) CONTROL OF PLATEN SHAPE IN CHEMICAL MECHANICAL POLISHING

(71) Applicant: Applied Materials, Inc., Santa Clara, CA (US)

(72) Inventors: Steven M. Zuniga, Soquel, CA (US); Jay Gurusamy, Santa Clara, CA (US); Jeonghoon Oh, Saratoga, CA (US)

(73) Assignee: Applied Materials, Inc., Santa Clara, CA (US)

( * ) Notice: Subject to any disclaimer, the term of this patent is extended or adjusted under 35 U.S.C. 154(b) by 323 days.

(21) Appl. No.: 18/214,456

(22) Filed: Jun. 26, 2023

(65) Prior Publication Data

US 2024/0424636 A1 Dec. 26, 2024

Related U.S. Application Data

(60) Provisional application No. 63/355,996, filed on Jun. 27, 2022.

(51) Int. Cl.

| | |
|---|---|
| ***B24B 37/26*** | (2012.01) |
| ***B24B 37/10*** | (2012.01) |
| ***B24B 41/02*** | (2006.01) |

(52) U.S. Cl.

CPC ..... *B24B 37/26* (2013.01); *B24B 37/10* (2013.01); *B24B 41/02* (2013.01)

(58) Field of Classification Search

CPC ..... H01L 21/68764; H01L 21/68785; H01L 21/68792; H01L 21/68742; H01L 21/6875;

(Continued)

(56) References Cited

U.S. PATENT DOCUMENTS 5,738,574 A * 4/1998 Tolles ..... H01L 21/67057 451/247

5,899,801 A 5/1999 Tolles et al.

(Continued)

FOREIGN PATENT DOCUMENTS

EP 0747167 12/1996
JP H05-084659 4/1993

(Continued)

OTHER PUBLICATIONS

International Search Report and Written Opinion in International Appln. No. PCT/US2019/066597, dated Apr. 16, 2020, 12 pages.

(Continued)

*Primary Examiner* — Monica S Carter
*Assistant Examiner* — Kent N Shum
(74) *Attorney, Agent, or Firm* — Fish & Richardson P.C.

(57) ABSTRACT

A chemical mechanical polishing apparatus includes a platen to support a polishing pad, an actuator, a carrier head to hold a surface of a substrate against the polishing pad, a motor to generate relative motion between the platen and the carrier head so as to polish an overlying layer on the substrate. The platen has a central section with an upper surface and an annular flexure surrounding or surrounded by the central section and having a top surface with a first edge adjacent to and coplanar with the upper surface and a second edge farther from the central section. The actuator is arranged to bend the annular flexure along an entire circumference of the annular flexure so as to modify a vertical position of the second edge of the annular flexure relative to the central section.

16 Claims, 5 Drawing Sheets

(58) Field of Classification Search
CPC ..... B24B 37/013; B24B 37/27; B24B 37/26; B24B 37/10; B24B 41/02; B24B 41/06
See application file for complete search history.

(56) References Cited

U.S. PATENT DOCUMENTS

| | | | | |
|---|---|---|---|---|
| 5,980,368 | A | 11/1999 | Chang et al. | |
| 6,435,949 | B1 | 8/2002 | Katsuoka et al. | |
| 6,607,425 | B1 * | 8/2003 | Kistler | B24B 37/16 451/41 |
| 6,913,518 | B2 | 7/2005 | Chen et al. | |
| 6,939,212 | B1 | 9/2005 | Pham | |
| 7,018,273 | B1 * | 3/2006 | Kiermasz | B24B 21/10 451/41 |
| 7,422,516 | B2 | 9/2008 | Butterfield et al. | |
| 9,662,762 | B2 | 5/2017 | Gurusamy et al. | |
| 10,058,974 | B1 | 8/2018 | Chen et al. | |
| 10,464,184 | B2 | 11/2019 | Zhang et al. | |
| 2002/0033230 | A1 | 3/2002 | Hayashi et al. | |
| 2002/0127953 | A1 | 9/2002 | Doan et al. | |
| 2003/0003850 | A1 | 1/2003 | Eaton | |
| 2003/0060134 | A1 | 3/2003 | Gurusamy et al. | |
| 2004/0224615 | A1 * | 11/2004 | Chen | B24B 37/16 451/41 |
| 2005/0020185 | A1 | 1/2005 | Zuniga et al. | |
| 2005/0113010 | A1 * | 5/2005 | Kim | B24D 7/14 451/285 |
| 2009/0117835 | A1 | 5/2009 | Shih | |
| 2010/0120334 | A1 | 5/2010 | Crocco et al. | |
| 2011/0021115 | A1 | 1/2011 | Oh et al. | |
| 2011/0239876 | A1 | 10/2011 | Brown | |
| 2012/0171933 | A1 | 7/2012 | Chen | |
| 2014/0273765 | A1 | 9/2014 | Chang et al. | |
| 2014/0273766 | A1 | 9/2014 | Chang et al. | |
| 2015/0065020 | A1 | 3/2015 | Roy et al. | |
| 2017/0274495 | A1 | 9/2017 | Lau et al. | |
| 2018/0056477 | A1 | 3/2018 | Butterfield et al. | |
| 2018/0250788 | A1 | 9/2018 | Lau et al. | |
| 2020/0130131 | A1 * | 4/2020 | Togawa | B24B 49/04 |
| 2020/0206866 | A1 | 7/2020 | Gurusamy et al. | |
| 2022/0266413 | A1 | 8/2022 | Lischka et al. | |
| 2023/0415295 | A1 | 12/2023 | Zuniga et al. | |

FOREIGN PATENT DOCUMENTS

| | | | |
|---|---|---|---|
| JP | 08-090406 | A | 4/1996 |
| JP | H08-090406 | | 4/1996 |
| JP | H0890406 | A * | 4/1996 |
| JP | 2001-060572 | A | 3/2001 |
| JP | 2002-233948 | | 8/2002 |
| TW | 201543563 | | 11/2015 |
| WO | WO 2002/078901 | | 10/2002 |

OTHER PUBLICATIONS

International Search Report and Written Opinion in International Appln. No. PCT/US2023/026233, dated Oct. 17, 2023, 12 pages.
Office Action in Taiwanese Appln. No. 112123844, dated Jun. 19, 2024, 18 pages (with English summary and search report).
Office Action in Japanese Appln. No. 2024-575509, mailed on Jan. 6, 2026, 8 pages (with English translation).

* cited by examiner

CONTROL OF PLATEN SHAPE IN CHEMICAL MECHANICAL POLISHING

CROSS-REFERENCE TO RELATED APPLICATIONS

This application claims the benefit of priority to U.S. Application No. 63/355,996, filed on Jun. 27, 2022, the contents of which are hereby incorporated by reference.

TECHNICAL FIELD

The disclosure relates to chemical mechanical polishing, and more specifically to controlling platen shape in chemical mechanical polishing.

BACKGROUND

An integrated circuit is typically formed on a substrate by the sequential deposition of conductive, semiconductive, or insulative layers on a silicon wafer. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the metallic layer remaining between the raised pattern of the insulative layer form vias, plugs, and lines that provide conductive paths between thin film circuits on the substrate. For other applications, such as oxide polishing, the filler layer is planarized, e.g., by polishing for a predetermined time period, to leave a portion of the filler layer over the nonplanar surface. In addition, planarization of the substrate surface is usually required for photolithography.

One problem in CMP is variations in the material removal rate, and subsequent thickness profile, of the substrate. Variations in the slurry distribution, polishing pad condition, the relative speed between the polishing pad and the substrate, and the inconsistent load on the substrate from the pressurized chambers of the carrier head can cause variations in the material removal rate. These variations, as well as variations in the initial thickness of the substrate layer, cause variations final substrate layer thickness, particularly in edge regions.

SUMMARY

Disclosed herein is a chemical mechanical polishing apparatus including annular flexures in one or more regions of a platen supporting a polishing pad. The annular flexures are controlled to vertically bias the outer edge. The carrier head moves a portion of the substrate over the flexed outer edge to locally increase or decrease the polishing rate, which can reduce the presence of polishing non-uniformities in the polishing substrate. A controller of the apparatus commands the displacement, or position, of the annular flexures through actuators supported by the platen.

The apparatus includes an in-situ monitoring system, such as an optical monitoring system, which receives a signal indicative of a radial thickness profile of an overlying layer of material on the substrate. The controller processes the signal and determines whether additional polishing is needed in an annular region of the substrate, for example an annular region at the edge of the substrate. When additional polishing is needed, the controller causes the actuators to flex the annular flexures upward, whereas when less polishing is needed the controller causes the actuators to flex the annular flexure downward. The carrier head moves a portion of the substrate over the flexed region for additional polishing.

The carrier head moves the substrate off of the flexed annular region and the thickness profile is re-determined. If the thickness profile is within a uniformity threshold, additional polishing (if needed) can be performed without using the annular flexure region. If the thickness profile does not meet the uniformity threshold, the controller determines that additional polishing over the annular flexure is needed.

In one aspect, a chemical mechanical polishing apparatus includes a platen to support a polishing pad, an actuator, a carrier head to hold a surface of a substrate against the polishing pad, a motor to generate relative motion between the platen and the carrier head so as to polish an overlying layer on the substrate. The platen has a central section with an upper surface and an annular flexure surrounding or surrounded by the central section and having a top surface with a first edge adjacent to and coplanar with the upper surface and a second edge farther from the central section. The actuator is arranged to bend the annular flexure along an entire circumference of the annular flexure so as to modify a vertical position of the second edge of the annular flexure relative to the central section.

In another aspect, a method of polishing a substrate includes supporting a polishing pad with a rotatable platen, the platen comprising at least one annular flexure extending from a central region of the platen and an actuator supported by the platen configured to adjust a vertical height of an edge of the annular flexure relative to the central region along an entire circumference of the annular flexure, positioning the substrate so that a portion of the substrate is over the annular flexure, moving the annular region of the substrate over the annular section, and generating relative motion between a polishing pad and a substrate so as to polish an overlying layer on the substrate.

In another aspect, a chemical mechanical polishing apparatus includes a platen to support a polishing pad, a carrier head to hold a surface of a substrate against the polishing pad, and a motor to generate relative motion between the platen and the carrier head so as to polish an overlying layer on the substrate. The platen has a central section with an upper surface and an annular flexure surrounding or surrounded by the central section and having a top surface with a first edge adjacent to and coplanar with the upper surface and a second edge farther from the central section. The annular flexure is tapered to be thinner toward the second edge. The actuator is arranged to bend the annular flexure so as to modify a vertical position of the second edge of the annular flexure relative to the central section.

In another aspect, a chemical mechanical polishing apparatus includes a platen to support a polishing pad, a carrier head to hold a surface of a substrate against the polishing pad, and a motor to generate relative motion between the platen and the carrier head so as to polish an overlying layer on the substrate. The platen has an upper portion and a lower portion, the upper portion having a central section with an upper surface. An annular flexure surrounds or is surrounded by the central section and has a top surface with a first edge adjacent to and coplanar with the upper surface and a second edge farther from the central section. A pressurizable chamber between the upper platen and lower platen is configured such that modifying pressurization of the chamber bends the annular flexure so as to modify a vertical position of the second edge of then annular flexure.

In another aspect, a chemical mechanical polishing apparatus includes a platen that has a lower platen and an upper platen to support a polishing pad, a carrier head to hold a surface of a substrate against the polishing pad, and a motor to generate relative motion between the platen and the carrier head so as to polish an overlying layer on the substrate. The upper platen has a vertically movable central section and an annular outer section surrounding the central section and coupled to the central section by an annular bendable portion. An outer edge of the annular outer section is supported by and vertically fixed relative to the lower platen. An actuator is arranged to adjust a vertical position of the central section and an inner edge of the annular outer section so as to modify a tilt of the annular outer section.

Particular implementations of the subject matter described in this specification can be implemented so as to realize one or more of the following technical advantages.

Radially-specific thickness profile correction can be performed, and within-wafer non-uniformity and wafer-to-wafer non-uniformity can be reduced. Material removal can compensate for thickness profile non-uniformities in edge regions induced following a main polishing step or to correct incoming substrate film thickness profiles before undergoing primary polishing. The amount of flex (e.g., displacement from a planar configuration) by the annular flexures results in a modification of pressure applied to the substrate surface rather than through the substrate backside, increasing the polishing location specificity during location-specific polishing. The dimensions of the region of increased pressure can be small compared to the overall substrate surface area and can be controlled by positioning of the substrate with the carrier head, allowing material removal in highly specific areas.

The details of one or more embodiments are set forth in the accompanying drawings and the description below. Other aspects, features and advantages will be apparent from the description and drawings, and from the claims.

DETAILED DESCRIPTION

In some chemical mechanical polishing operations, a portion of a substrate can be under-polished or over-polished. In particular, the substrate tends to be over-polished or under-polished at or near the substrate edge. One technique to address such polishing non-uniformity is to have multiple controllable pressurizable chambers in the carrier head. However, pressure applied from the backside of the substrate tends to "spread," such that compensation for radially localized can be difficult. Another technique is to transfer the substrate to a separate "touch up" tool, e.g., to perform edge-correction. However, the additional tool consumes valuable footprint within the clean room, and can have an adverse effect on throughput.

An alternative approach is to have a platen with independently controllable annular flexures which are deflectable, e.g., upwardly or downwardly. A portion of the substrate is then moved over the deflected flexure, which results in increased or decreased pressure between the polishing pad and the substrate at that portion, and thus enables radially-targeted polishing of an edge portion of the substrate.

Although some approaches for an adjustable platen have been proposed, such systems are not known to be commercialized and can generally be expected to pose other problems. For example, in a system with vertically adjustable concentric platens, the vertical displacement between the platens can create a height discontinuity that poses a danger of damage to the substrate.

Figure 1:
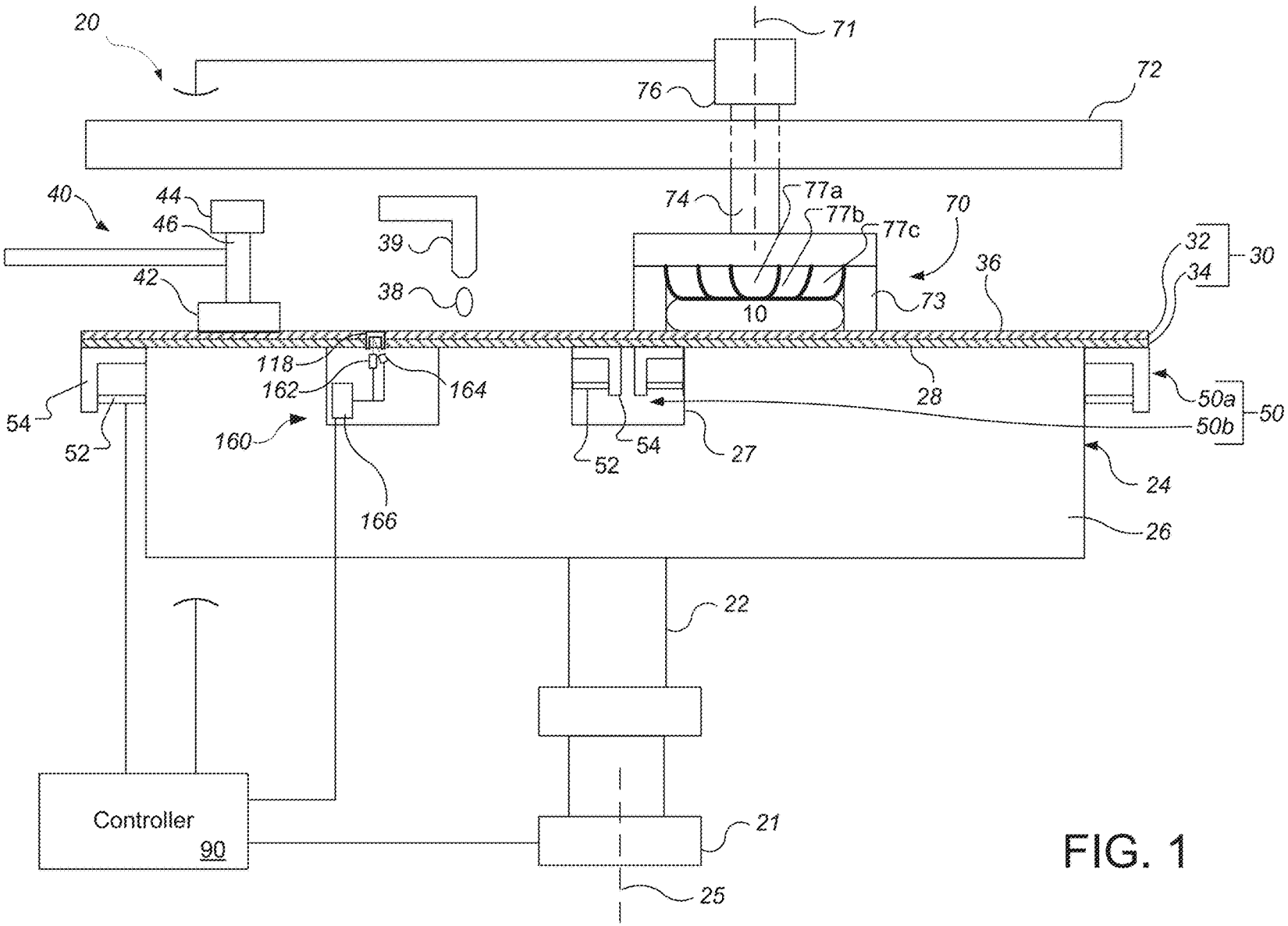
FIG. 1 illustrates a schematic cross-sectional view of an example of a polishing apparatus having an optical monitoring system and two annular flexures.

FIG. 1 shows a polishing system 20 operable to polish a substrate 10. The polishing system 20 includes a rotatable platen 24, on which a main polishing pad 30 is situated. The platen is operable to rotate about an axis of rotation 25. For example, a motor 21 can turn a drive shaft 22 to rotate the platen 24. In some implementations, the platen 24 includes a central section 26 which is configured to provide an annular upper surface 28 to support the main polishing pad 30.

The main polishing pad 30 can be secured to the upper surface 28 of the central section 26 of the platen 24, for example, by a layer of adhesive. When worn, the main polishing pad 30 can be detached and replaced. The main polishing pad 30 can be a two-layer polishing pad with an outer polishing layer 32 having a polishing surface, and a softer backing layer 34.

The polishing system 20 can include a polishing liquid delivery arm 39 and/or a pad cleaning system such as a rinse fluid delivery arm. During polishing, the arm 39 is operable to dispense a polishing liquid 38, e.g., slurry with abrasive particles. In some implementations, the polishing system 20 include a combined slurry/rinse arm. Alternatively, the polishing system can include a port in the platen operable to dispense the polishing liquid 38 onto the main polishing pad 30. The polishing system 20 can also include a conditioner system 40 with a rotatable conditioner head 42, which can include an abrasive lower surface, e.g. on a removable conditioning disk, to condition the polishing surface 36 of the main polishing pad 30.

The polishing system 20 includes a carrier head 70 operable to hold the substrate 10 against the main polishing pad 30. The carrier head 70 is suspended from a support structure 72, for example, a carousel or track, and is connected by a carrier drive shaft 74 to a carrier head rotation motor 76 so that the carrier head can rotate about an axis 71. In addition, the carrier head 70 can oscillate laterally across the polishing pad, e.g., by moving in a radial slot in the carousel as driven by an actuator, by rotation of the carousel as driven by a motor, or movement back and forth along the track as driven by an actuator. In operation, the platen 24 is rotated about its central axis of rotation 25, and the carrier head is rotated about its central axis 71 and translated laterally across the top surface of the polishing pad.

The carrier head 70 can include a retaining ring 73 to retain the substrate 10 below a flexible membrane 144. The carrier head 70 also includes one or more independently controllable pressurizable chambers defined by the membrane, e.g., three chambers 77*a*-77*c*, which can apply independently controllable pressurizes to associated zones on the flexible membrane 144 and thus on the substrate 10. Although only three chambers are illustrated in FIG. 1 for ease of illustration, there could be one or two chambers, or four or more chambers, e.g., five chambers.

A controller 90, such as a programmable computer, is connected to the motors 21, 76 to control the rotation rate of the platen 24 and carrier head 70. For example, each motor can include an encoder that measures the rotation rate of the associated drive shaft. A feedback control circuit, which could be in the motor itself, part of the controller, or a separate circuit, receives the measured rotation rate from the encoder and adjusts the current supplied to the motor to ensure that the rotation rate of the drive shaft matches at a rotation rate received from the controller.

The polishing system 20 also includes at least one annular flexure 50 that is secured to and rotates with the platen 24. A portion of the polishing pad 30 supported on the platen 24 extends above the flexure 50. The flexure 50 is deformable by one or more actuators 52. The polishing system 20 can include an annular flexure 50*a* that projects outwardly from an outer edge of the platen 24. Or if the platen 24 is itself annular, the polishing system can include an annular flexure 50*b* that projects inwardly from an inner edge of the annular platen 24. Or there can be two flexures, e.g., flexure 50*a* and flexure 50*b*, one for an outer edge and one for an inner edge of the platen 24.

When the annular flexure 50 is flexed upward, a radially-limited outer section of the polishing pad 30 is urged upwardly. If a portion of a substrate 10 is present over the flexure, pressure against that portion will increase. Conversely, when the annular flexure 50 is flexed downward, a radially-limited outer section of the polishing pad 30 is urged downward. If a portion of a substrate 10 is present over the flexure, pressure against that portion will decrease. As used herein, the terms "upward" and "downward" are in reference to the orientation of FIG. 1. Upward refers to the direction from the platen 24 to the polishing pad 30 to the substrate 10, while downward refers to the reverse; in operation the polishing surface could be oriented vertically or some other orientation with respect to gravity.

The annular flexure 50 extends from the outer edge of the platen 24 by a distance in a range from 5% to 20% of the radius of the polishing pad 30 (e.g., from 5% to 15%, from 5% to 10%, from 10% to 15%, or from 15% to 20%).

In some implementations, the polishing apparatus includes an in-situ monitoring system 160, e.g., an optical monitoring system, such as a spectrographic monitoring system which can be used to measure a spectrum of reflected light from a substrate undergoing polishing. The monitoring system 160 can include a sensor supported on the platen, e.g., an end of an optical fiber that is coupled to a light source 162 and a light detector 164. Due to the rotation of the platen, as the sensor travels below the carrier head 70 and the substrate 10, the monitoring system 160 receives measurements at a sampling frequency causing the measurements to be taken at locations in an arc that traverses the substrate 10. From the measurements, the in-situ monitoring system 160 produces a signal which depends on the thickness of the layer of material being polished, e.g., a thickness profile. Additionally or alternatively, the in-situ monitoring system 160 produces a signal which depends on the polishing rate of the layer of material being polished, e.g., a polishing rate profile.

The controller 90 receives the signal, converts the signal to a process profile, e.g., a thickness profile or polishing rate profile, and compares the process profile to a target profile. For example, the target profile can be a pre-determined target thickness profile for the radially-dependent thickness of the layer at the end of polishing, or a target polishing rate profile storing radially-dependent target polishing rates during polishing. The process profile can be based on measurements over the radial width of the substrate 10, or a portion of the radial width of the substrate 10. In some implementations, the controller 90 calculates a process profile for the portion of the substrate 10 corresponding to the outermost annular region of the substrate 10, such as the outermost 5%, the outermost 10%, or the outermost 20% of the substrate.

The controller 90 compares the process profile to a target profile. If the process profile differs from the target profile by more than a threshold amount, the controller 90 determines to change a polishing parameter. If the difference occurs in a region of the substrate that is controllable by the flexure, e.g., in an outermost annular region adjacent an edge of the substrate 10. then the flexure can be used to compensate for the departure of the process profile from the target profile.

If the polishing rate of the region of the substrate is above a target polishing rate, the controller 90 can determine to position the region over the flexure and deflect the flexure downward. The downward deflection reduces the polishing rate in that region to achieve the target polishing rate profile. If the polishing rate in that region of the substrate is below the target polishing rate for that region, the controller 90 can determine to position the region over the flexure and deflect the flexure upward to increase the polishing rate of that region.

As shown in the example of FIG. 1, the polishing system 20 includes an annular flexure 50 that projects radially outward from the central section 26 of the platen 24. If not deflected or deformed, a top surface of the annular flexure 50 is substantially coplanar with the upper surface 28 of the platen 24. An inner edge of the annular flexure 50 is secured to and rotatable with the platen 24. Therefore the annular flexure 50 rotates with the platen 24 when the drive shaft 22 rotates the platen 24 (so the annular flexure 50 does not require a separate motor for rotation).

The annular flexure 50 is connected to at least one actuator 52 which is arranged to be supported by the central section 26 of the platen 24. In some implementations, such as the example of FIG. 1, the actuators 52 is arranged to provide a substantially lateral force on a flange 54. The flange 54 projects downwardly from an outer edge of the annular flexure 50. In such implementations, the actuator 52 provides a force inward (e.g., toward axis of rotation 25) or a force outward (e.g., away from axis of rotation 25). The system 20 includes a sufficient number of actuators 52 to control the outer edge of the annular flexure 50 around the circumference of the platen 24. The system 20 can include two or more, four or more, or eight or more actuators 52. Where there are multiple actuators, the actuators can be spaced at uniform angles around the rotational axis 25 of the platen 24.

As the actuators 52 provide an inward force, the outer edge of the upper surface of the annular flexure 50 is flexed downward. Conversely, as the actuators 52 provide an outward force, the outer edge of the upper surface of the annular flexure 50 is flexed upward. The controller 90 controls the actuators 52 to adjust the force on the flange 54 to control the outer edge of the upper surface of the annular flexure 50 to flex upward or downward.

The system can be configured such that the annular flexure 50 flexes along an entire circumference of the flexure 50. In some implementations, there is a single actuator, and the flexure 50 is sufficiently stiff along the angular that pressure from the actuator in a limited area causes the flexure 50 to flex along the entire circumference. In some implementations, there are multiple actuators, and the actuators is electrically ganged to a single control signal such that all actuators are driven in unison. In some implementations, each of the actuators 52 is individually controllable by the controller 90, but the controller 90 controls all of the actuators 52 to flex the annular flexure 50 along the entirety of the circumference.

In many polishing processes, the outer edge of the substrate 10 is under-polished due to reduced pressure control in the outermost radial areas of the three chambers 77*a*-77*c*, resulting in increased layer thickness at the edges of the substrate 10. As such, the annular flexure 50 is flexed upward and biased against the bottom surface of the substrate 10 to increase the pressure between the substrate 10 and the polishing pad 30.

The controller 90 operates the actuators 52 to alter a position of an outer edge of the annular flexure 50 upward or downward by a distance. In some implementations, the distance is in a range from 1 micron to 300 microns (e.g., 1 micron to 250 microns, 10 microns to 250 microns, 50 microns to 250 microns, 10 microns to 50 microns, or 1 microns to 50 microns).

Here and throughout the specification, reference to a measurable value such as an amount, a temporal duration, and the like, the recitation of the value should be taken as disclosure of the precise value, of disclosure of approximately the value, and of disclosure of about the value, e.g., within ±10% of the value. For example, here reference to 100 microns can be taken as a reference to any of precisely 100 microns, approximately 100 microns, and within ±10% of 100 microns.

In some implementations, the annular platen 24 includes a recess 27 at the center of the platen 24 which partially extends through the thickness of the platen 24, aligned with the axis of rotation 25. For example, the recess 27 can be circular and the center of the recess 27 can be co-axial with the axis of rotation 25. In some implementations, the recess 27 extends through the entire thickness of the platen 24.

The recess houses a central annular flexure 51 including a flange 54 and one or more actuators 52 to apply a force to the flange 54. The inner edge of the central annular flexure 51 (e.g., nearest the axis of rotation 25) flexes upward or downward based on the force applied to the flange 54 by the actuators 52 while the outer edge of the central annular flexure 51 remains substantially coplanar with the upper surface 28.

The central annular flexure 51 extends from the inner edge of the platen 24 by a distance in a range from 5% to 25% of the innermost radius of the polishing pad 30 (e.g., from 5% to 15%, from 5% to 10%, from 10% to 25%, or from 15% to 25%).

Figure 2A:
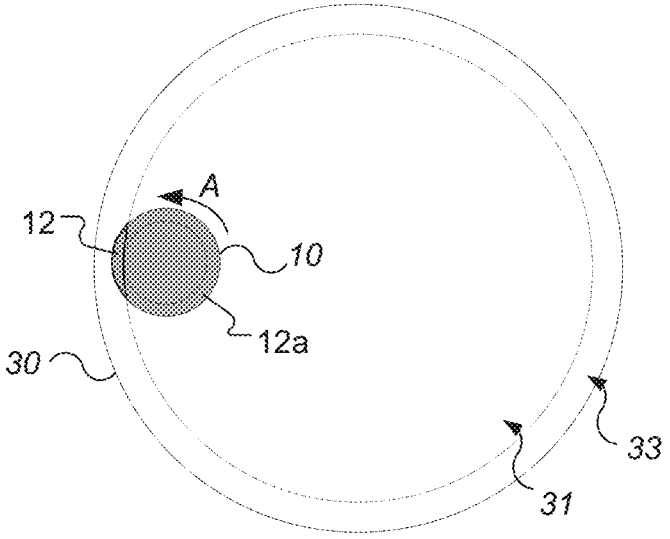
FIGS. 2A and 2B illustrate a top-down view of a polishing pad including inner and outer regions of increased polishing rate.
Figure 2B:
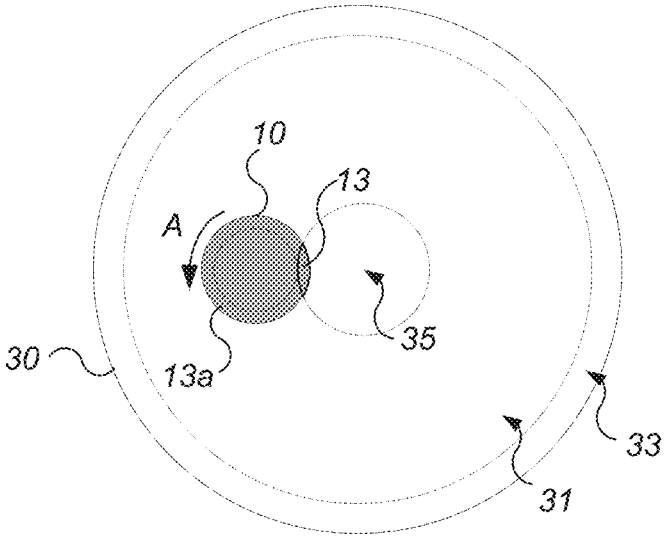

The arrangement of the actuators 52, outer annular flexure 50*a*, and central annular flexure 50*b* define regions of the pad 30 in which the pressure between the pad 30 and substrate 10 is controlled at least in part by the amount of flexing provided by the actuators 52. Referring to FIGS. 2A and 2B, top-down views of the polishing pad 30 and substrate 10 are shown and particular polishing regions are outlined. FIG. 2A depicts an implementation in which the apparatus 100 includes only an outer annular flexure 50*a*, while FIG. 2B depicts an implementation in which the apparatus 100 includes the outer annular flexure 50*a* and the central annular flexure 50*b*. While the retaining ring 73 surrounds the substrate 10 in the apparatus 100 during a polishing operation, the component has been visually removed in FIG. 2A and 2B for simplification.

Referring to FIG. 1 and FIG. 2A, a top view of the pad 30 supported by the platen 24 and the substrate 10 is shown in which the system 20 includes only the outer annular flexure 50*a*. The central section 26 of the platen 24 supports a central region 31 of the pad 30. The annular flexure 50*a* is arranged circumferentially around the platen 24 and supports an outer region 33. The outer edge of the outer region 33 flexes upward or downward while the inner edge of the outer region 33 remains substantially coplanar with the central region 31.

The substrate 10 is moved by the carrier head 70 such that a portion 12 of the substrate 10 is above the outer region 33. Depending on whether the flexure 50*a* is biased upwardly or downwardly, the outer region 33 will experience increased or decreased pressure against the portion 12 of the substrate 10. Due to the rotation (shown by arrow A) of the carrier head 70 and substrate 10, an annular section 12*a* of the substrate 10 experiences an increased or decreased polishing rate (compared to the flexure remaining in a planar state).

Referring to FIGS. 1 and 2B, a top view of the pad 30 supported by the platen 24 and the substrate 10 is shown in which the system 20 includes the annular flexure 50 and the central annular flexure 50*b*. The central annular flexure 50*b* defines an inner region 35 of the polishing pad 30 while the outer annular flexure 50*a* defines the outer region 33. The polishing pad 30 supported by the central section 26 which remains substantially planar during polishing is defined as the central region 31. In this manner, the outer region 33 and the inner region 35 define two regions in which the pressure between the substrate 10 and the polishing pad 30 can be modified.

As the substrate 10 is passed over the inner region 35 by the carrier head 70 (not shown), a portion 13 of the substrate 10 overlaps the inner region 35. As the inner region 35 is flexed upwardly or downwardly by the central annular flexure 51, the portion 13 is subject to increased or decreased pressure. Again, due to the rotation (shown by arrow A) of the carrier head 70 and substrate 10, an annular section 13*a* of the substrate 10 experiences an increased or decreased polishing rate. In the embodiments of FIGS. 2A and 2B, assuming the substrate edge is otherwise under-polished, the polishing rate for the portions 12 and 13 of the substrate 10 which overlap the inner region 35 and the outer region 33 can increased to compensate and thus improve within wafer and wafer-to-wafer uniformity.

The carrier head 70 passes the substrate 10 over the central region 31 and the optical monitoring system 160 receives a signal indicative of an updated thickness of the overlying layer of material, e.g., an updated thickness profile, and calculates a new uniformity value for the updated thickness profile.

The controller 90 compares the updated uniformity value to the uniformity threshold. If the uniformity value is below the uniformity threshold, the controller 90 determines to discontinue increased polishing of the region of the substrate 10 corresponding with the region exceeding the uniformity threshold.

Figure 3A:
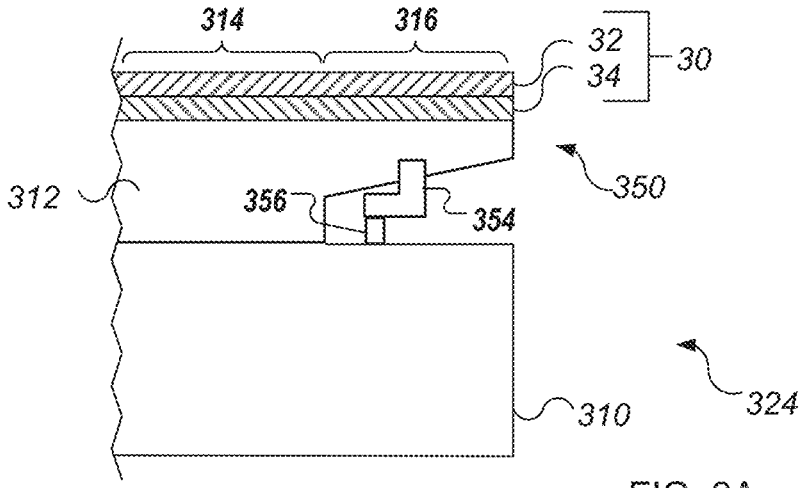
FIGS. 3A-3C illustrate schematic cross-sectional view of example embodiments of annular flexure actuation.
Figure 3B:
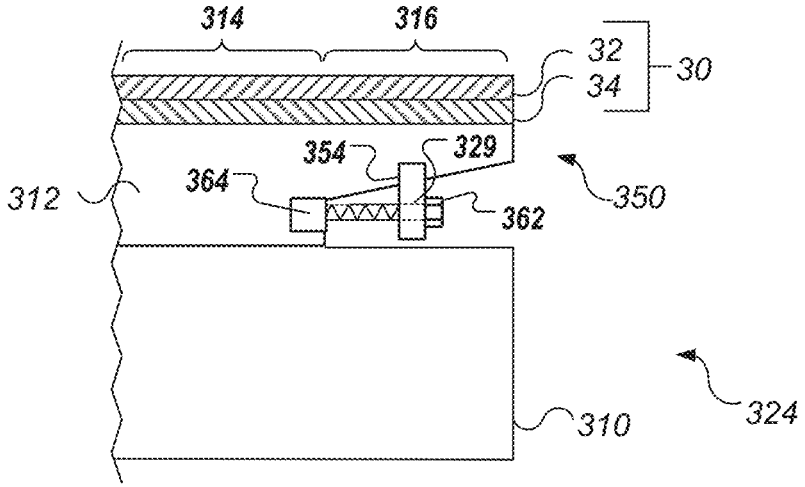
Figure 3C:
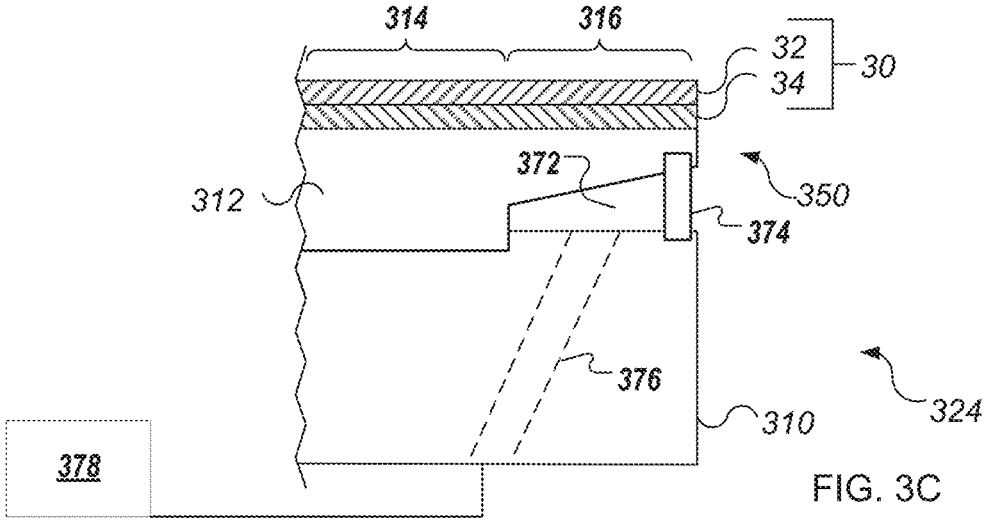

FIGS. 3A to 3C illustrate exemplary implementations for achieving the flexing of an edge portion of a platen 324, which can provide the platen 24. In the implementations of FIGS. 3A-3C, the platen 324 includes a lower platen 310 and an upper platen 312. The upper platen 312 supports the polishing pad 30 and is supported by the lower platen 310. The upper platen 312 is composed of a material which has sufficient flexibility to achieve the flexing distance of the annular flexure 50 while being sufficiently durable and incompressible to be compatible with polishing operations.

In some examples, the upper platen 312 is composed of a polymer material, or a metallic material such as aluminum.

The upper platen 312 includes a tapered region 350, which can provide the flexure 50. For the outer annular flexure 50*a* the tapered region can be an annular outer region 316 of the upper platen 312; for the inner annular flexure 50*b* the tapered region can be an annular inner region of the upper platen 312. The tapered region 350 can have a reduced thickness compared to the inner central region 314. In addition, the tapered region 350 tapers to a minimum edge thickness at the outer edge of the outer region 316 (or at the inner edge of the inner region). The example of FIG. 3A utilizes an annular flange 354 and radially spaced actuators 356 which produces forces on the flange 354 to flex the tapered region 350 of the upper platen 312. The flange 354 can be integral to the tapered region 350 of the upper platen 312 or the flange 354 can be a separate piece of manufacture attached to the tapered region 350. Due to the taper, the edge of the tapered region is more flexible, and thus more subject to deflection. As a result, the actuators can induce a smoothly curving surface in the flexure 50 (as opposed to a surface with a sharp corner).

The example of FIG. 3B utilizes adjustment screws 362 radially spaced around the upper platen 312 to apply forces to the flange 354 in the plane of the upper platen 312, e.g., horizontally. Each of the adjustment screws 362 pass through an aperture 329 which extends through each flange 354.

In some implementations, the upper platen 312 includes rotary actuators 364 that are connected to the adjustment screws 362. The controller 90 controls the rotary actuators 364 to translate the adjustment screws 362 inward, e.g., toward the central axis 125, or outward, e.g., away from the central axis 125. The force applied in the plane of the upper platen 312 flexes the tapered region 350 downward or upward based on the translation of the adjustment screws 362 inward or outward, respectively.

Alternatively, the upper platen 312 includes static threaded recesses aligned with the aperture 329 such that adjustment screws 362 extending through the flange 354 are manually driven or withdrawn into the upper platen 312 to adjust the degree of flex of the tapered region 350.

The example of FIG. 3C, an annular void 372 between the tapered region 350 and the platen 310 is sealed against gas flow by an annular seal 374. The platen 310 includes channels 376 which fluidically connect the void 372 to a gas pressurization system 378. The gas pressurization system 378 operates to change the gas pressure of the annular void 372. Increasing the gas pressure of the void 372 above a threshold pushes the upper surface of the tapered region 350 upward, while decreasing the gas pressure below the threshold pulls the upper surface of the tapered region 350 downward.

The gas pressure applies force uniformly to the inner surfaces of the void 372. In some examples, the annular seal 374 connecting the outer edge of the upper platen 312 to the outer edge of the platen 310 maintains the position of the upper platen 312 edge when the gas pressure in the void 372 increases above the threshold. This achieves a curved upper surface of the outer region 316 of the upper platen 312 with a point between the edge of the central region 314 and the outer edge of the outer region 316 being the most displaced.

Figure 4A:
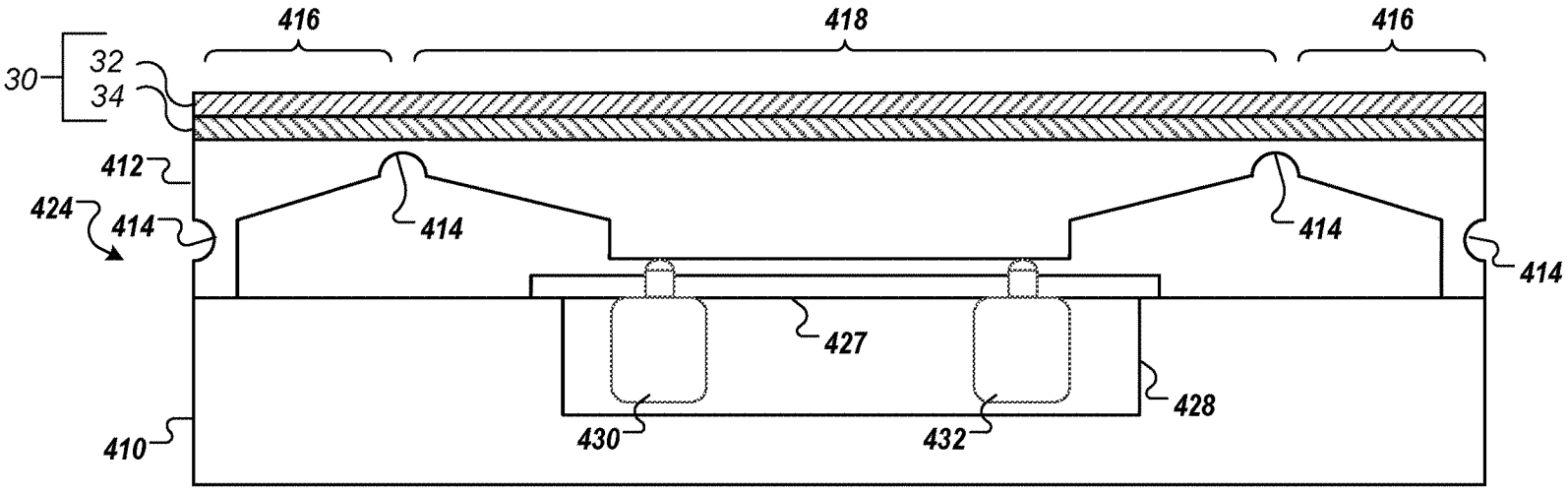
FIGS. 4A and 4B illustrate schematic cross-sectional views of example polishing apparatuses having a lower platen and an upper platen divided into regions to achieve targeted polishing.
Figure 4B:
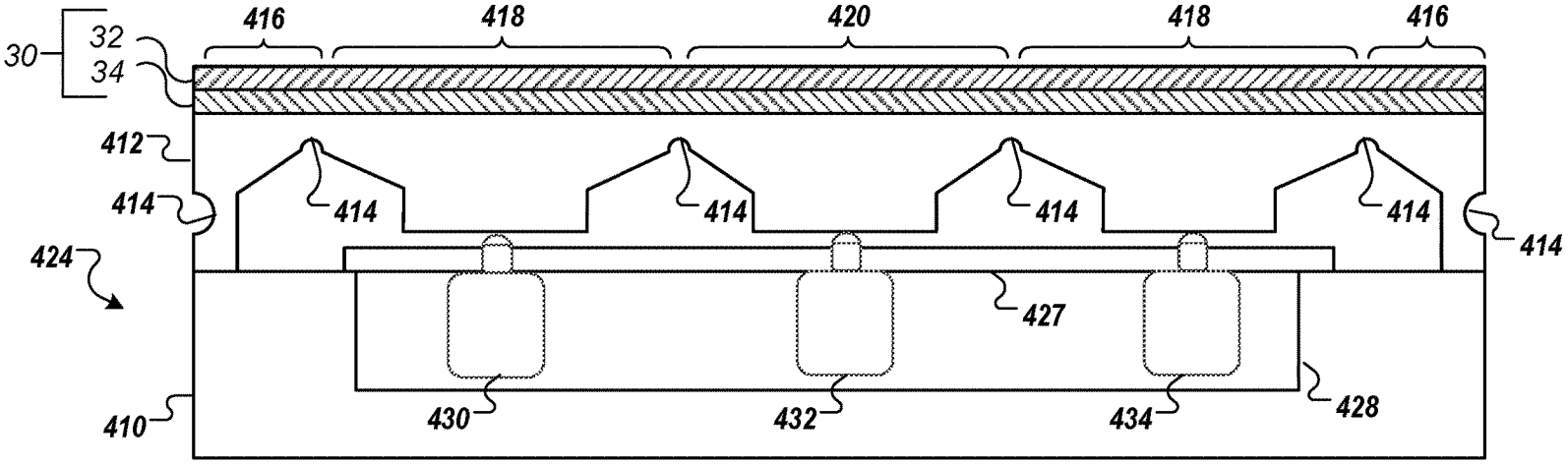

In some implementations, the upper platen 312 is constructed from multiple sections which are independently actuated to achieve the desired configuration of the polishing pad 30. FIGS. 4A and 4B show example configurations of a rotatable platen 24 in which the upper platen 412 is divided into several portions by flexures 414, e.g., points of higher flexibility than surrounding material. The flexures 414 can be achieved by annular regions of reduced thickness in the upper platen 312 material, or separately constructed of a more flexible material than the remaining upper platen 412, e.g., the outer region 416 or the inner section 418. The regions of reduced thickness can be formed by recesses formed into a lower surface of the platen 24; when not actively biased the top surface of the platen can be substantially planar.

The lower platen 410 includes a recess 428 in which an actuator, or actuators, is arranged. The actuator provide a vertical force to the inner section 418. In such implementations, the vertical position of the inner section 418 is controlled to adjust the polishing rate in the outer region 416. In the example of FIG. 4A, the recess 428 houses two actuators 430 and 432 which are supported by a support 427. The actuators 430 and 432 provide a vertical force (e.g., parallel with central axis 125) to the inner section 418, displacing the inner section 418 upward or downward with respect to the outer region 416 edge to achieve differential polishing of regions of substrate 10 in contact with the outer region 416.

In some implementations, the upper platen 412 is divided into more than two regions having differential polishing rates. In the example implementation of FIG. 4B, three actuators 430, 432, and 434 are supported by the support 427 in the recess 428. The actuators 430, 432, and 434 control the position of the inner section 418, and a central section 420. In such an implementation, the vertical positions of the inner section 418 and central section 420 are controlled independently such that one or more sections create a position differential creating a pressure bias against the substrate 10.

Figure 5:
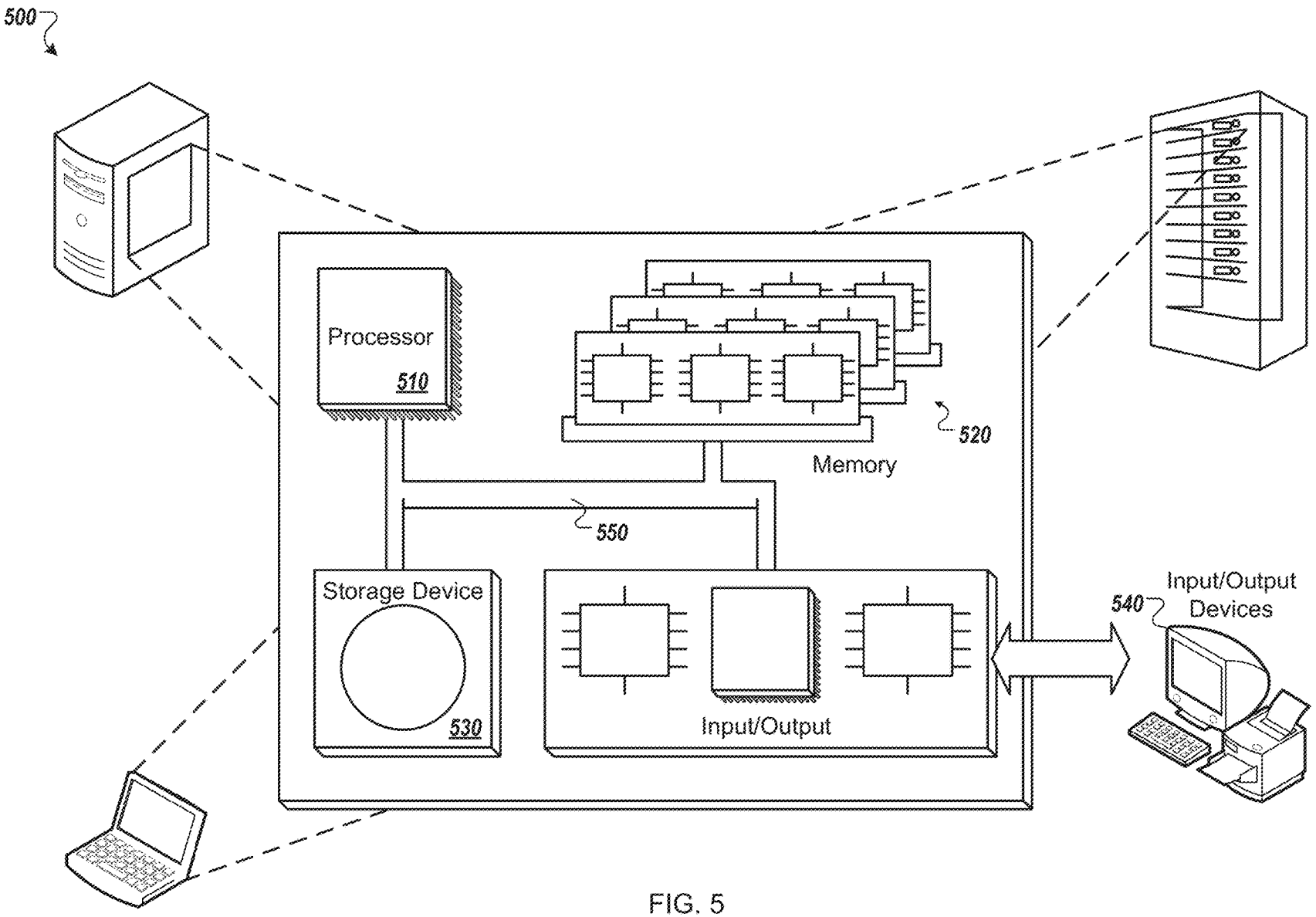
FIG. 5 illustrates schematic diagrams of example computing devices. In the figures, like references indicate like elements.

FIG. 5 is a block diagram of an example computer system 500. For example, controller 190 can be an example of the system 500 described here, as could a computer system used by any of the users who access resources of the system 500. The system 500 includes a processor 510, a memory 520, a storage device 530, and one or more input/output interface devices 540. Each of the components 510, 520, 530, and 540 can be interconnected, for example, using a system bus 550.

The processor 510 is capable of processing instructions for execution within the system 500. The term "execution" as used here refers to a technique in which program code causes a processor to carry out one or more processor instructions. In some implementations, the processor 510 is a single-threaded processor. In some implementations, the processor 510 is a multi-threaded processor. The processor 510 is capable of processing instructions stored in the memory 520 or on the storage device 530. The processor 510 may execute operations such as controlling a polishing operation as described herein.

The memory 520 stores information within the system 500. In some implementations, the memory 520 is a computer-readable medium. In some implementations, the memory 520 is a volatile memory unit. In some implementations, the memory 520 is a non-volatile memory unit.

The storage device 530 is capable of providing mass storage for the system 500. In some implementations, the storage device 530 is a non-transitory computer-readable medium. In various different implementations, the storage device 530 can include, for example, a hard disk device, an optical disk device, a solid-state drive, or a flash drive. In some implementations, the storage device 530 may be a cloud storage device, e.g., a logical storage device including one or more physical storage devices distributed on a network and accessed using a network.

The input/output interface devices 540 provide input/output operations for the system 500. In some implementations, the input/output interface devices 540 can include one or more of a network interface device, e.g., an Ethernet interface, and/or a wireless interface device. A network interface device allows the system 500 to communicate, for example, transmit and receive data by way of a network. In some implementations, mobile computing devices, mobile communication devices, and other devices can be used.

Software can be realized by instructions that upon execution cause one or more processing devices to carry out the processes and functions described above. Such instructions can include, for example, interpreted instructions such as script instructions, or executable code, or other instructions stored in a computer readable medium.

Although an example processing system has been described in FIG. 5, implementations of the subject matter and the functional operations described above can be implemented in other types of digital electronic circuitry, or in computer software, firmware, or hardware, including the structures disclosed in this specification and their structural equivalents, or in combinations of one or more of them. Implementations of the subject matter described in this specification, such as storing, maintaining, and displaying artifacts can be implemented as one or more computer program products, i.e., one or more modules of computer program instructions encoded on a tangible program carrier, for example a computer-readable medium, for execution by, or to control the operation of, a processing system. The computer readable medium can be a machine readable storage device, a machine readable storage substrate, a memory device, or a combination of one or more of them.

A computer program (also known as a program, software, software application, script, executable logic, or code) can be written in any form of programming language, including compiled or interpreted languages, or declarative or procedural languages, and it can be deployed in any form, including as a standalone program or as a module, component, subroutine, or other unit suitable for use in a computing environment. Computer readable media suitable for storing computer program instructions and data include all forms of non-volatile or volatile memory, media and memory devices.

While this specification contains many details, these should not be construed as limitations on the scope of what may be claimed, but rather as descriptions of features specific to particular examples. Certain features that are described in this specification in the context of separate implementations can also be combined. Conversely, various features that are described in the context of a single implementation can also be implemented in multiple embodiments separately or in any suitable subcombination.

What is claimed is:

1. A chemical mechanical polishing apparatus, comprising:

a platen that is rotatable about an axis of rotation and that includes a lower platen, and a unitary upper platen to support a polishing pad, the upper platen having a vertically movable section, and an annular outer section surrounding the vertically movable section concentric with the axis of rotation of the platen, a first annular bendable portion provided by a first thinned region concentric with the axis of rotation and coupling an outer edge of the annular outer section of to the lower platen such that the outer edge of the annular outer section is supported by and vertically fixed relative to the lower platen, and a second annular bendable portion provided by a second thinned region concentric with the axis of rotation of the platen and coupling an outer edge of the vertically movable section to an inner edge of the annular outer section;

an actuator arranged to adjust a vertical position of the vertically movable section such that as the vertically movable section lifts or lowers the first annular bendable portion, the second annular bendable portion bends and the inner edge of the annular outer section lifts and lowers with the vertically movable section so as to modify a tilt of the annular outer section;

a carrier head to hold a surface of a substrate against the polishing pad; and a motor to rotate the platen to generate relative motion between the platen and the carrier head so as to polish an overlying layer on the substrate.

2. The apparatus of claim 1, wherein a top surface of the second annular bendable portion spans between top surfaces of the vertically movable section and the annular outer section.

3. The apparatus of claim 2, wherein upper surfaces of the vertically movable section, the second annular bendable portion, and the annular outer section are positionable to be coplanar.

4. The apparatus of claim 3, wherein the upper surfaces of the vertically movable section, the second annular bendable portion, and the annular outer section are coplanar when not actively biased by the actuator.

5. The apparatus of claim 2, wherein the second annular bendable portion is provided by an annular recess formed into a lower surface of the upper platen.

6. The apparatus of claim 1, wherein the second annular bendable portion is provided by an annular recess formed into a lower surface of the upper platen.

7. The apparatus of claim 1, wherein the vertically movable section is a circular central section of the upper platen.

8. The apparatus of claim 1, wherein the vertically movable section is an annular inner section.

9. The apparatus of claim 8, and wherein the upper platen has a vertically movable circular central section surrounded by the annular inner section and coupled to the annular inner section by a third annular bendable portion, and further comprising a second actuator arranged to adjust a vertical position of the circular central section.

10. The apparatus of claim 9, wherein a top surface of the third annular bendable portion spans between top surfaces of the circular central section and the annular inner section.

11. The apparatus of claim 10, wherein the top surface of the circular central section, the third annular bendable portion, and the annular inner section are positionable to be coplanar.

12. The apparatus of claim 1, wherein the first annular bendable portion comprises a recess in an outer surface of the upper platen.

13. The apparatus of claim 1, wherein the vertically movable section is tapered to be thinner toward the annular outer section.

14. The apparatus of claim 1, wherein the annular outer section is tapered to be thinner toward the vertically movable section.

15. The apparatus of claim 1, wherein the actuator is positioned to apply a vertical force to the vertically movable section.

16. The apparatus of claim 1, comprising a plurality of actuators electrically ganged to a single control signal such that all actuators are driven in unison.

* * * * *